US005196116A

United States Patent [19]

Ackerson et al.

[11] Patent Number: 5,196,116

[45] Date of Patent: Mar. 23, 1993

[54] PROCESS FOR PETROLEUM - WAX SEPARATION AT OR ABOVE ROOM TEMPERATURE

[75] Inventors: Michael D. Ackerson, Fayetteville, Ark.; Seyed-Hamid Arabshahi, Houston, Tex.; Robert E. Babcock, Fayetteville, Ark.

[73] Assignees: University of Arkansas, Little Rock; Diversified Petroleum Recovery, Inc., North Little Rock, both of Ark.

[21] Appl. No.: 653,626

[22] Filed: Feb. 11, 1991

[51] Int. Cl.[5] ..... C10G 73/06; C10G 73/08

[52] U.S. Cl. ..... 208/33; 208/35; 208/36

[58] Field of Search ..... 208/33, 35, 36

[56] References Cited

U.S. PATENT DOCUMENTS

| | | | |
|---|---|---|---|
| 1,956,780 | 5/1934 | Voorhees | 208/33 |
| 2,044,724 | 6/1936 | Govers | 208/36 |
| 2,410,483 | 11/1946 | Dons et al. | 208/33 |
| 2,880,159 | 3/1959 | Livingstone et al. | 208/31 |
| 3,041,268 | 6/1962 | Arabian et al. | 208/31 |
| 3,773,650 | 11/1973 | Hislop et al. | 208/33 |
| 3,871,991 | 3/1975 | Shaw | 208/33 |
| 3,972,802 | 8/1976 | Bushnell | 208/33 |
| 4,111,790 | 9/1978 | West | 208/33 |
| 4,514,280 | 4/1985 | Shaw et al. | 208/33 |
| 4,673,484 | 6/1987 | Babcock et al. | 208/435 |

*Primary Examiner*—Theodore Morris
*Assistant Examiner*—P. L. Hailey
*Attorney, Agent, or Firm*—Robert R. Keegan

[57] ABSTRACT

There are disclosed processes for separating waxes of different melting points from a room temperature amorphous or liquid hydrocarbon mixture in an energy conservative manner by selectively causing precipitation of crystallized waxes. The processes involve the use of a selected co-solvent totally miscible with light and intermediate hydrocarbons from a group consisting of acetone, ketene, propanone, 2-propanone, methanol, ethanol, isopropanol, N-propanol, acetic acid, formic acid, and propionic acid or combinations thereof as a precipitating agent. Hydrocarbon mixtures, especially those with elevated pour points are first diluted by solvents such as toluene and/or methylethyl ketone which must be free of any significant quantity of the aforesaid co-solvents. The diluted hydrocarbon mixture at above 50 degrees F. is mixed with one or more of such selected co-solvents in a ratio preferably between 1:1 and 10:1 by weight to the heavy hydrocarbon content of the mixture; five minutes or more without artificial cooling is allowed to permit crystallization of waxes which are removed in solid form by a physical process such as filtering, settling, or the like. By controlling the amount and nature of the selected co-solvent and by including or excluding water or brine with the co-solvent, valuable waxes of high melting point may be selectively separated, or all waxes may be removed indiscriminately; performing the separation process in several stages of adding co-solvent and/or water permits selecting out more valuable high melting point waxes first before succeeding stages reduce the wax conter t of the remaining liquid hydrocarbon to minimal values to enhance its value.

48 Claims, 1 Drawing Sheet

PROCESS FOR PETROLEUM - WAX SEPARATION AT OR ABOVE ROOM TEMPERATURE

Figure 1:
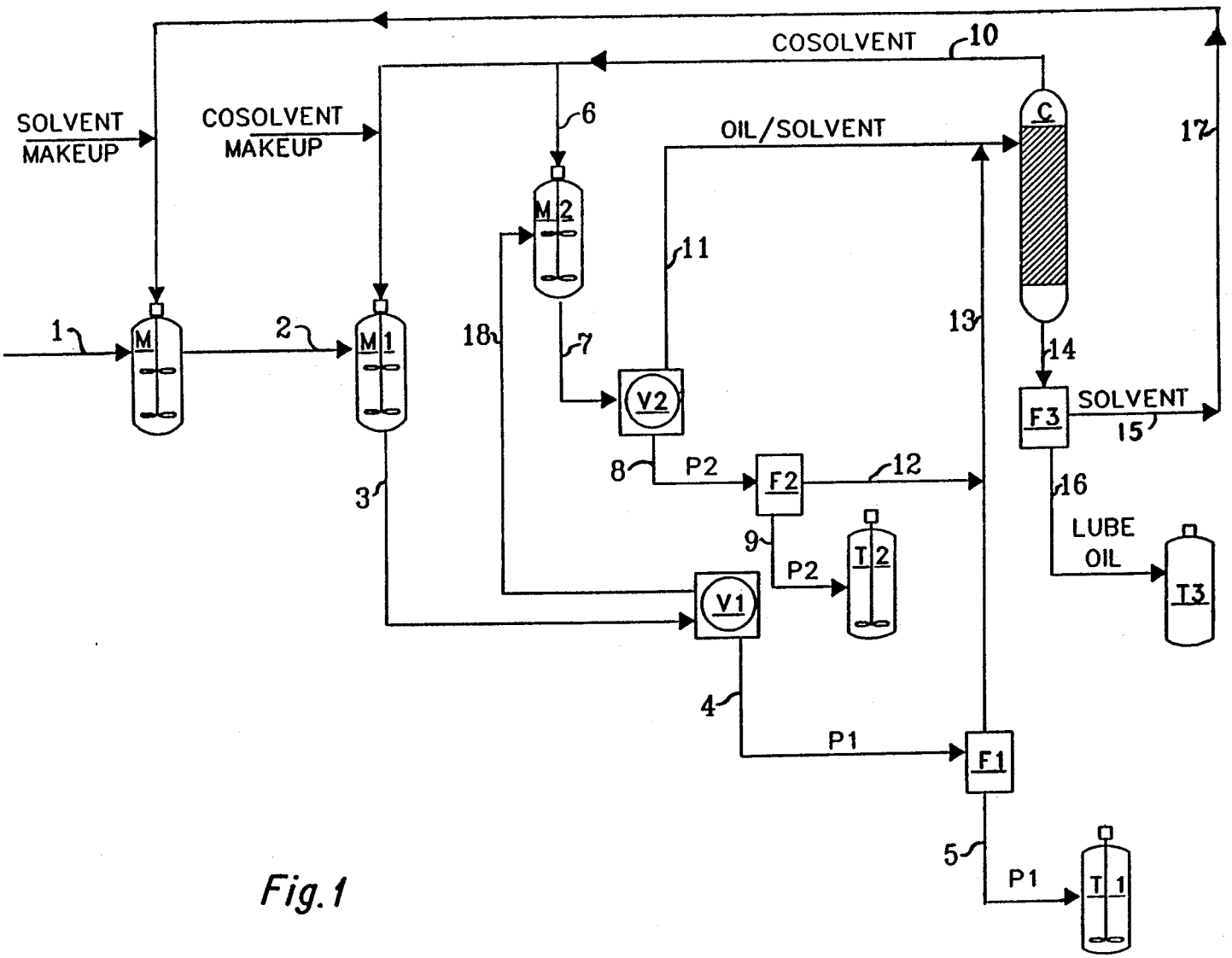

The present invention relates to dewaxing of petroleum products (and possibly other heavy hydrocarbon mixtures). It also relates to similar processes for deoiling the waxes that are found in combination with heavy hydrocarbon mixtures. It will be understood that when the term dewaxing is used herein it will also include other similar processes such as deoiling. Wax as used in the present description will include all compounds or mixtures to which the term wax is applied, both natural and synthetic, and also will include in general saturated hydrocarbon chain link compounds.

Crude petroleum and partially refined petroleum commonly contain waxes (usually paraffin waxes). Such waxes crystallize at low temperatures, and this is particularly notable with high molecular weight n-paraffins, certain isoparaffins, and cycloparaffins.

When the petroleum is being refined for use as lubricating oil, the presence of these materials which crystallize within a range of temperatures for which the lubricating oil is intended is very deleterious. Such materials are therefore commonly removed in the refining process and this subprocess is referred to as dewaxing.

There is great variety in the processes used for dewaxing as it cannot be carried out as a normal consequence of the fractional distillation process. The oldest and simplest form of dewaxing is chilling of the crude lubricating oil to about the desired pour point temperature causing crystallization of most of the wax components, after which they may be physically removed by filtration or the like. This process is largely of historical interest because of its high cost and unsuitability for processing heavy oils.

The straight chilling process for dewaxing wax was improved by inclusion of an initial step of adding a relatively large proportion of solvent or diluent to the oil prior to the chilling process. Early types of diluents used in this solvent dewaxing process were heavy naphtha or gas oil. In recent years a great variety of solvents have been employed in conjunction with the chilling step to endeavor to increase efficiency and otherwise improve results.

It was found that somewhat better solvent-chilling dewaxing results were achieved with a mixture of two solvents and thus various mixtures of two different solvents have been employed as dewaxing solvents. Perhaps the most frequently used dewaxing solvent at the present time has been methylethylketone (MEK)/-benzene. A common dewaxing solvent may contain 25% to 50% of MEK, 40% to 60% of benzene, and 12% to 25% of toluene. Sometimes ketones of higher molecular weight have been used in place of MEK. This permits one to obtain a higher solvent power for heavy oil. In some solvent-chilling dewax operations the high crystallization temperature (about 5° C.) of benzene has caused toluene to be substituted for the benzene so that the diluent is essentially a mixture of MEK and toluene.

A common solvent-chilling dewax process may proceed as follows. The solvent may be an MEK/benzene combination, or toluene may substitute for the benzene in the solvent combination. After the solvent is added to the oil charge it is normally heated slightly to insure complete solution of wax components. The mixture is then chilled to the required filtration temperature, usually of the order of −20° C. utilizing a conventional refrigeration process. Refrigeration is typically carried out by pipe-in-pipe type heat exchangers with oil in the inside pipe, the surface of which must be kept free of wax by scraper blades to maintain adequate heat transfer. The wax may be removed by filtration under vacuum in conventional rotary filters in a well known manner.

There are other processes for solvent-chilling dewaxing, such as propane dewaxing in which a single effective constituent is present in the solvent. Propane dewaxing has certain advantages in that it may be a follow-on to propane deasphalting, thereby eliminating a propane-oil separation step between the stages of the process. A disadvantage of propane is that the required dewaxing temperatures are generally lower.

The process of the present invention is strikingly different in that it does not rely on chilling below normal ambient temperature for crystallization of and precipitation of the wax. The dewaxing process of the present invention is most generally characterized by the absence of any required chilling step in the process which normally is carried out about room temperature or above, namely above about 55° F. (12.8° C.). Of course, mere elimination of the cooling or refrigeration step using the previously known solvent-chilling dewaxing processes would not and could not result in an operable or practical process. Otherwise the expensive refrigeration step would not have been required.

Therefore, it is another distinguishing feature of the solvent dewaxing process of the present invention that it involves two separate dilution steps or solvent addition steps with two distinctly different solvents. Hereinafter the first solvent will be referred to as the primary solvent, or simply the solvent, and the second solvent will be referred to as the co-solvent (or selected co-solvent). The term "co-solvent" as used herein will have a specially defined meaning, not to be confused with various meanings for co-solvent which may be found in other contexts.

The second solvent, or the "selected co-solvent" as it will be termed, is selected from a relatively small group of chemical compounds which are in the liquid state at or above room temperature (at a pressure of less than ten atmospheres). In this discussion, room temperature will be understood to be a rather wide range of temperatures about 20° C. (68° F.) plus or minus 10° C. (18° F.).

The group from which the selected co-solvent is taken is the group of ketones, alcohols and organic acids having a molecular composition with a low carbon number, preferably of three or less, and having one or two oxygen atoms plus an even number (2–8) of hydrogen atoms. Specifically these compounds are: methanol, ethanol, propanol, isopropanol, acetic acid, formic acid, propionic acid, formaldehyde, acetone, ketene, acetaldehyde, and propionaldehyde. The above twelve compounds have the physical characteristic of total miscibility with light-to-internediate (herein defined as C number of less than fourteen) hydrocarbons and, very importantly, miscibility with water. At the same time, they have low solubility for waxes. One or more of these compounds (acetone) has been used in a solvent-chilling dewaxing process, but only admixed with a different solvent such as toluene as a primary solvent.

In the process according to the present invention, the requirements for the primary solvent are not very strict and most light-to-intermediate hydrocarbons known and commonly used as solvents may be employed alone, or in admixture, for the primary solvent. There is only one requirement for the primary solvent, that is should not contain any significant quantity of the selected co-solvents described above. Admixture of the co-solvent with the solvent before addition to the petroleum feed stock substantially destroys the effectiveness of the selected co-solvent in crystallizing and precipitating the wax components from the petroleum hydrocarbon mixture at room temperature or above. The effectiveness of the selected co-solvents described above for room temperature dewaxing processes has apparently been overlooked because incidental use of any of the selected co-solvents has been in admixture with a primary solvent such as toluene, benzene, and/or MEK.

Where the process according to the invention is directed to dewaxing a petroleum feed stock to obtain an end product with sufficiently low residual wax content for high quality lubricating oil, this can be accomplished, if desired, in a single stage of steps of primary solvent dilution, selected co-solvent dilution, precipitation and filtering. Of course, a practical industrial process normally involves a closed loop system for recovery and reuse of solvents, as will be more fully explained hereinafter.

There are two desirable objectives in the separation of wax from petroleum or other hydrocarbons, one of which is obtaining a high quality lubricating oil with mineral residual wax content as previously described. The other advantage to be obtained is to maximize the potential value of the recovered waxes themselves. Waxes are used in a great many industrial processes for wax coating paper or paperboard products and other uses too numerous to mention. High quality waxes are also a component of numerous consumer products. In general, the desirability and hence the value of waxes is directly related to their high melting or softening temperature which is in turn related to their high molecular weight. The process according to the present invention can be carried out in a manner to separately recover waxes of highest value, thereby inexpensively producing a by-product capable of substantially contributing to the profitability of the overall operation. The process when carried out in this form is still capable of further removal of the waxes of lower molecular weight (and generally lower value) substantially in their entirety to produce a nearly wax-free lubricating oil of high quality.

When the process is modified to maximize the value of recovered waxes, the selected co-solvent diluent is added in at least two different stages rather than in one stage. It has been found that reducing the amount or proportion of the selected co-solvent diluent has two effects. One is that the quantity of wax precipitated is reduced. The other effect is that the wax produced is of a higher average molecular weight and higher melting point, and thus has substantially higher potential value. These higher value waxes are removed in a conventional filtering process and may be further deoiled by additional washing with the same or similar solvents. The value of the wax recovered in this form of the process is quite high and may be on the order of $1.00 a pound. Following the recovery of the high molecular weight wax, the filtrate would be transported to a second stage of selected co-solvent dilution, generally with little or no further treatment of the filtrate. At this point it would contain the original petroleum feed stock with the residual wax that had not been removed, the added primary solvent such as toluene or benzene, and a limited proportion of the selected co-solvent, acetone for example.

With the addition of a greater quantity of selected co-solvent such as acetone, it has been found that additional quantitites of wax in the solution will crystallize and precipitate allowing them to be removed by a physical process such as filtration. The addition of water at this point will aid in completing the wax crystallization process. Still further crystallization may be induced by the use of brine with or in place of the water, but certain disadvantages accruing from brine introduction would make this generally a less preferable variation of the process. If desired, substantially complete removal of waxes can be accomplished in the second stage or the wax removal can be divided into still more stages of selected co-solvent (possibly with water) dilution, precipitation, and filtration, each stage having wax product produced with lower molecular weight and lower melting point than the previous stage.

Throughout this explanation it should be kept in mind that in all stages of the process, refrigeration or cooling by artificial means is not required, thereby greatly simplifying the process and greatly reducing the expense of this essential aspect of petroleum refining.

As previously mentioned, there have been great efforts expended and great numbers of proposals made for improving, simplifying and economizing the petroleum dewaxing process. There are few effective organic solvents known to man which have not been proposed for use in one or another of these actual or suggested dewaxing processes. Thus the selected co-solvents as used in the present invention, or at least closely related compounds, have been mentioned in connection with other dewaxing processes.

In general however, the low carbon number (three C or less) ketones, alcohols and organic acids forming the group of selected co-solvents utilized in processes according to the present invention have seldom been employed in solvent-chilling dewaxing. Exceptions are acetone or alcohols which have been suggested as a constituent of a mixed primary solvent in processes described in the following patents:

| PATENT NO. | CLASS | INVENTOR(S) | DATE |
|---|---|---|---|
| 4,673,484 | (208/435) | Babcock, et al | 06-16-87 |
| 4,514,280 | (208/33) | Shaw, et al | 04-30-85 |
| 2,880,159 | (208-31) | Livingstone, et al | 07-20-55 |
| 3,773,650 | (208-33) | Hislop, et al | 11-20-73 |
| 3,041,268 | (208-31) | Arabian, et al | 12-23-59 |
| 3,972,802 | (208-33) | Bushnell | 08-03-76 |
| 4,111,790 | (208-33) | West | 09-05-78 |

These processes are presented as solvent-chilling dewaxing processes, which is significant to show that using one of the present selected co-solvents, acetone for example, in admixture with light-intermediate hydrocarbons as a primary solvent does not and cannot result in crystallization and precipitation of waxes at room temperature and elimination of the necessity for refrigeration or artificial cooling. As to some of the twelve above-listed selected co-solvents, there is no known use of them in a petroleum dewaxing process, even as an added constituent to a primary solvent mixture.

In addition to providing the features and advantages described above, it is an object of the present invention to provide a solvent dewaxing process for substantially complete dewaxing of crude or partially refined petroleum at temperatures no lower than 50° F. (10° C.).

It is another object of the present invention to provide a dewaxing process for liquid or amorphous heavy hydrocarbons in which two distinctly different diluents are used sequentially in the process, the second of such diluents being a selected co-solvent consisting essentially of one or more ketones, alcohols or organic acids with a carbon number of three or less, and the first of said diluents being any one or more of a general class of commonly used solvents for dewaxing except that such primary solvent specifically excludes any significant amount of such selected co-solvents.

It is still another object of the present invention to provide a process for separating wax from a liquid or amorphous hydrocarbon mixture including two steps of adding controlled amounts of selected co-solvents consisting essentially of one or more alcohols, ketones, or organic acids with a carbon number of three or less, the first quantity of such co-solvent being limited to cause crystallization and precipitation of only high molecular weight, high melting point waxes, while the second quantity of selected co-solvent is sufficient to crystallize and precipitate substantial quantities of lower molecular weight waxes.

It is yet another object of the present invention to provide a deoiling process for waxes recovered from liquid or amorphous hydrocarbon mixtures producing high quality wax of high molecular weight wherein a quantity of selected co-solvent is added to a liquid hydrocarbon mixture at room temperature or above and crystallized wax is thereby precipitated, after which it is recovered by filtering and washed with a liquid including the same selected co-solvent to further remove residual oil from the wax after which the washing co-solvent is separated from the high quality, high molecular weight wax by filtration and/or evaporation.

Other objects and advantages of the present invention will be apparent from consideration of the following description in conjunction with the appended drawing in which the single FIG. 1 shows a flow chart of steps in an apparatus for a process of petroleum wax separation at or above room temperature according to the invention.

As seen in FIG. 1, a feed stock enters the process at 1 where it is mixed in a conventional mixing tank M with a primary solvent. By way of example only, the feed stock may consist of waxy heavy vacuum gas oil and the primary solvent, for example toluene, may be in ratio of 2:1 by weight to the feed stock. Unless otherwise stated all proportions herein are proportions by weight.

The primary solvent provided through line 17 and the feed stock provided through line 1 are mixed in mixing tank M to obtain a homogeneous solution, and this step may be facilitated by heating the solution to a temperature above ambient temperature, up to about 120° F. (or 48.9° C.). The output from mixing tank M is supplied through line 2 to mixing tank M1 where it is mixed with a selected co-solvent consisting essentially of acetone, the ratio of acetone to feed stock being 3:8 in this example. It should be noted that the primary solvent may include commonly used solvents other than toluene, but it should not contain any significant amount of the selected co-solvent, acetone.

The temperature of the mixing tank M1 and contents is not critical but will normally be slightly above ambient temperature, in this example 78° F. (or 25.6° C.).

The addition of the selected co-solvent acetone in the mixture of mixing tank M1 spontaneously produces crystallization of a high melt fraction of the wax content of the feed stock. The relatively low ratio of acetone to feed stock causes only high molecular weight, high melt temperature wax crystals to form. The wax crystals precipitate from the solution, and this mixture is fed through line three to a conventional vacuum filter apparatus V1. Exiting the vacuum filter apparatus V1 through line 4 is a product designated P1, at this point comprising a waxy slurry which is conveyed through line 4 to a solvent evaporation step at F1 which may be performed by a conventional flash evaporation apparatus.

From F1 the removed wax is conveyed through line 5 to product P1 storage tank T1. Although product P1 may be further washed or refined, such steps are conventional and not shown in FIG. 1 for simplicity and clarity. Product P1 in storage tank T1 may be heated and mildly agitated to prevent solidification pending further processing thereof.

The evaporated feed stock, primary solvent, and co-solvent from flash evaporator F1 is supplied to distillation column C through line 13. As will be more fully explained hereinafter, the process flow diagram of FIG. 1 includes solvent and co-solvent recovery steps which are necessary for a practical system, although they are not a critical feature of the present invention. In this regard, it may be desired to select the chemical compounds utilized for the primary solvent and/or the chemical compounds used for the selected co-solvent with a view to ease of separating them in the recovery process. As previously explained, this separation is necessary particularly from the point of view of eliminating any significant amount of selected co-solvent in the primary solvent make up. In the example being described, the selected co-solvent acetone has a substantially lower boiling point than the primary solvent toluene, thus making virtually complete separation of the co-solvent and primary solvent easy to accomplish in a conventional distillation column.

Considering now the filtrate from rotary vacuum filter V1, it is supplied through line 18 to a mixing tank M2; thus the filtrate from the first stage may be used essentially without further treatment in a second stage of wax separation. An additional quantity of selected co-solvent (acetone) is supplied through line 6 to mixing tank M2. The quantity of additional co-solvent for the second stage will normally be equal to or greater than the amount of co-solvent for the first stage. In the present example, the additional selected co-solvent in the second stage is double that of the first stage. That is, the ratio of second stage co-solvent to original feed stock is 3:4. The process flow for the second stage proceeds substantially as for the first stage through rotary vacuum filter V2 and line 8 to solvent flash unit F2, which evaporates the residual oil solvent from product P2 into line 12 and to distillation column C; the product P2 then proceeds through line 9 to product P2 storage tank T2 in the same fashion as with product P1 and tank T1.

Dewaxed feed stock is transferred through line 14 from the recovery distillation column to a flash evaporator F3 in which the solvent is flashed and transported through lines 15 and 17 to be recycled while the dewaxed lube oil product is fed through line 16 to a lube oil storage tank T3.

The number of stages of wax separation is not limited to two and a third stage may be employed (not shown in FIG. 1). For example, a third stage may add an additional quantity of selected co-solvent (acetone) equal to that added in the second stage. In the third stage the vacuum filtered wax cake may be washed with a 1:1 toluene/acetone wash in a quantity of two and two-thirds of the amount of acetone added in the third stage. The filtrate from the third stage and the oil/solvent from the flash evaporator would be returned to the recovery distillation column C in the same manner as for the second stage.

Still further stages of wax separation could be employed and the number of stages will generally be determined with a view to economic factors which are subject to wide variation. Based on experiments and calculations, excellent yield of different qualities of wax will be obtained, represented by products P1, P2 (and P3 not shown in FIG. 1).

As previously explained in part, solvent and co-solvent recovery is provided for in the process flow diagram of FIG. 1. In the example given, the co-solvent acetone has the lower boiling point than the solvent toluene and this will normally, but not necessarily, be the case. Distillation column C obtains virtually complete separation of the selected co-solvent which is fed into co-solvent line 10 so that line 17 has no significant amount of selected co-solvent, which co-solvent would be very detrimental or even fatal to the process if introduced in the first stage mixing tank M.

Experiments and calculations have indicated that the following yields may be expected in a system corresponding to the process flow diagram of FIG. 1. With a feed stock of from 25% to 30% wax content one may expect a yield of approximately 5% (by weight) of high melting point wax (congealing point 172° F.) from stage 1 (P1).

A yield of approximately 8% of feed stock weight may be expected from stage 2 (P2). This wax will have an intermediate melting point (congealing point of about 160° F.).

In a third stage as described, the low melting point waxes of least value will be recovered with an expected quantity of about 12% of original feed stock weight, and a low melting point (congealing point of about 135° F.).

It should be particularly noted that contrary to most prior dewaxing systems, the present system allows the waxes to be recovered in separate stages characterized by different melting points, and thus different values. In most prior systems, it was necessary to conduct further processing of removed wax to separate desirable waxes of high value from those of little or no value. As seen from the above description, the separation of waxes is accomplished within the dewaxing process itself according to the present invention.

The processes according to the present invention are subject to wide variation not limited to the following examples. For clarity and definiteness certain terms will be considered to have special meaning for the purpose of this description and claims. Light-to-intermediate hydrocarbon will mean a hydrocarbon with a C-number of thirteen or less. Dewaxing will mean any process for separation of wax from oil or vice-versa. Oil will mean any liquid or amorphous hydrocarbon, natural or synthetic. Wax will mean any compound or mixture to which the term wax is applied, natural or synthetic. Co-solvent will mean a solvent in which the feed stock is soluble but which promotes separation of wax from the feed stock at temperatures above 50° F. (10° C.). Room temperature means a range of temperatures of 20° C. (68° F.) plus or minus 10° C. (18° F.). Liquid will mean any material which enters a liquid state at ambient pressure of ten atmospheres or less.

The following examples of processes according to the invention with specific materials, quantities, times, temperatures and other parameters should be considered to be illustrative and not restrictive of the scope of the present invention.

EXAMPLE 1

Example of multi-stage dewaxing or deoiling to sequentially and selectively remove wax fractions. Two hundred parts of a waxy heavy vacuum gas oil is mixed with four hundred parts of toluene and gently heated until a homogeneous solution is obtained. The mixture is allowed to cool to 78° F. (25.6° C.). In a first stage, seventy-five parts of acetone is added to precipitate a high melt fraction of wax crystals. The mixture is filtered by vacuum and the wax cake washed with forty parts of a toluene/acetone mixture having a ratio of toluene/acetone of 5:1. After the cake is heated to remove any solvents or co-solvents and weighed, a yield of eleven parts of wax is measured with a congealing point of 172° F. (77.8° C.).

The filtrate from the first stage is used in a second stage which removes additional wax. In the second stage an additional one hundred fifty parts of acetone is added to the filtrate from stage 1 and additional wax precipitates. The mixture is vacuum filtered and washed with one hundred fifty parts of a toluene/acetone mixture having a ratio of toluene/acetone of 2:1. After the wax cake is heated and weighed, a yield of fifteen parts of wax is measured with a congealing point of about 160° F. (71.1° C.).

The filtrate from the second stage is used in a third stage which removes additional wax. In the third stage an additional one hundred fifty parts of acetone is added to the filtrate from the second stage and additional wax precipitates. The mixture is vacuum filtered and the wax cake is washed with one hundred parts toluene-/acetone having a ratio of 1:1. After the wax cake is heated and weighed, a yield of twenty four parts of wax is measured with a congealing point of about 135° F. (57.2° C.).

EXAMPLE 2

This is an example of a dewaxing of heavy vacuum gas oil to produce a wax and low pour point oil suitable for lube oil stock. Twenty parts of toluene are mixed with ten parts of heavy vacuum gas oil feed stock and gently heated. The mixture is then allowed to cool to about 78° F. (25.6° C.). Thirty six parts of acetone are added and within minutes a wax precipitate forms. After adding the acetone, approximately one part of water is added to the mixture and additional wax precipitated. The wax is recovered by vacuum filtration and wax amounting to about seven parts by weight is obtained. The solvents are removed from the filtrate by distillation or flashing at about 232° C. (450° F.) maximum and oil product is obtained having a pour point of approximately 45° F. (7.2° C.).

EXAMPLE 3

Example of deoiling a slack wax: twenty parts of a slack wax having an oil content of approximately 10 percent are mixed with forty parts of toluene and heated gently to obtain a homogeneous solution. The mixture is then allowed to cool to 78° F. (28.6° C.). Fifty five parts of acetone are added and within minutes a precipitate forms. Two parts of water are added and the mixture is filtered to collect a wax cake. The wax cake is weighed and a yield of 17.94 parts is obtained having an oil content of less than one percent.

EXAMPLE 4

Vacuum gas oil having a pour point of 125° F. (51.7° C.) is contacted with a quantity of solvent equal to three times the weight of the oil sample containing toluene and methylethyl ketone (MEK) in about equal portions by weight and no significant quantity of acetone. After a homogeneous mixture is obtained, an amount of acetone equal to one-half the original oil sample is added, and a wax precipitate immediately is formed. The oil phase and wax phase are separated by filtration. This process has yielded a solid wax phase approximately equal to twenty percent of the original feed.

EXAMPLE 5

An oily liquid sample including petroleum containing approximately eight percent wax together with light or intermediate hydrocarbons is contacted with a quantity of methanol equal to four times the weight of the original sample. An amount of wax equal to seven percent of the original sample is precipitated and recovered.

EXAMPLE 6

The procedures are the same as in a selected one of Examples 1 to 3 except the toluene primary solvent in those examples is substituted for by a mixture of MEK and toluene in a ratio of approximately 1:1.

EXAMPLE 7

The procedures are the same as in a selected one of Examples 1 to 4 except that the toluene primary solvent in those examples is substituted for by a mixture of MEK and MIBK (methyl isobutyl ketone) in a ratio of 1:1.

EXAMPLE 8

The procedures are the same as in a selected one of Examples 1 to 4 except the toluene primary solvent in those examples is substituted for by a mixture of MEK, benzene, and toluene in a ratio of approximately 2:3:1.

EXAMPLE 9

Vacuum gas oil having a pour point of 125° F. (51.7° C.) is contacted with a quantity of solvent equal to three times the weight of the oil sample containing MEK and MiBK in equal portions by weight and no significant quantity of acetone. After a homogeneous mixture is obtained, an amount of acetone equal to one-half the original oil sample is added, and a wax precipitate immediately is formed. The oil phase and wax phase are separated by filtration.

EXAMPLE 10

The procedures are the same as in a selected one of Examples 1 to 4 except that the acetone selected co-solvent is substituted for by methanol.

EXAMPLE 11

The procedures are the same as in a selected one of Examples 1 to 5 except that the acetone or methanol selected co-solvent is substituted for by ketene.

EXAMPLE 12

The procedures are the same as one of Examples 1 to 4, or 6 to 8, except that the quantity of co-solvent in the first stage of dewaxing is increased by a factor of three and additional stages of dewaxing, if any, further increase the quantity of co-solvent.

EXAMPLE 13

Example of a single stage dewaxing or deoiling to remove waxy fractions or the like. Two hundred parts of a waxy heavy vacuum gas oil is mixed with four hundred parts of toluene or the like, and gently heated until a homogeneous solution is obtained. The mixture is allowed to cool to 78° F. (25.6° C.). Two hundred parts of acetone is added to precipitate the wax fraction. The mixture is filtered by vacuum and the wax cake washed with forty parts of a toluene/acetone mixture having a ratio of 5:1. After the cake is heated to remove any solvents and weighed, a yield of fifty parts of wax is measured with a congealing point of about 155° F. (68.3° C.).

EXAMPLE 14

The procedures are the same as Examples 1 to 13 except the feed stock is heated to at least 128° F. (53.33° C.).

EXAMPLE 15

The procedures are the same as Examples 1 to 14 except the wax cake is washed with ten times its weight of a mixture of toluene and the procedure co-solvent having a toluene ratio of 5:1.

EXAMPLE 16

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of acetone are added and within minutes a wax precipitate forms. After adding the acetone, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less then 32° F. (0° C.).

EXAMPLE 17

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of propanol are added and within minutes a wax precipitate forms. After adding the propanol, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 18

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of isopropanol are added and within minutes a wax precipitate forms. After adding the isopropanol, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F (0° C.).

EXAMPLE 19

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty parts of formic acid are added and within minutes a wax precipitate forms. After adding the formic acid, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 20

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Twenty four parts of methanol are added and within minutes a wax precipitate forms. After adding the methanol, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.), maximum and oil product is obtained having a pour point of less than 32° F. (0° C.).

EXAMPLE 21

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty parts of acetaldehyde are added and within minutes a wax precipitate forms. After adding the ketene, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 22

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty parts of acetaldehyde are added and within minutes a wax precipitate forms. After adding the acetaldehyde, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 23

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of acetic acid are added and within minutes a wax precipitate forms. After adding the acetic acid, approximately one part of water is added to the mixture and additional wax precipitated. The wax is recovered by vacuum filtration and wax amounting to about three to ten parts by weight is obtained. The solvents are removed from the filtrate by distillation or flashing at about 232° F.) maximum and oil product is obtained having a pour point of less than 32° F. (0° C.).

EXAMPLE 24

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of ethanol are added and within minutes a wax precipitate forms. After adding the ethanol, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 25

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty six parts of propionic acid are added and within minutes a wax precipitate forms. After adding the propionic acid, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 26

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty parts of formaldehyde are added and within minutes a wax precipitate forms. After adding the formaldehyde, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 27

This is an example of a dewaxing of heavy oil to produce a wax and low pour point oil suitable for lube oil stock. Twenty parts of toluene are mixed with ten parts of heavy oil feed stock and gently heated. The mixture is then allowed to cool to about 78° F. (25.6° C.). Thirty parts of propionaldehyde are added and within minutes a wax precipitate forms. After adding the propionaldehyde, approximately one part of water is added to the mixture and additional wax precipitated. The wax is recovered by vacuum filtration and wax amounting to about three to ten parts by weight is obtained. The solvents are removed from the filtrate by distillation or flashing at about 232° C. (450° F.) maximum and oil product is obtained having a pour point of less than 32° F. (0° C.).

EXAMPLE 28

The procedures are the same as in a selected one of Examples 16 to 27 except the toluene primary solvent in those examples is substituted for by a mixture of MEK and toluene in a ratio of approximately 1:1.

EXAMPLE 29

The procedures are the same as in a selected one of Examples 16 to 27 except that the toluene primary solvent in those examples is substituted for by a mixture of MEK and MIBK (methyl isobutyl ketone) in a ratio of 1:1.

EXAMPLE 30

One part of a heavy vacuum gas oil having a pour point of 125° F. (51.67° C.) is put into solution into one and one-half parts of ISOPAR G, an isoparaffinic solvent (product of Exxon Corp.), by gentle heating. After everything is in solution, the mixture is allowed to cool to room temperature. The mixture is then contacted with two parts of acetone producing a wax precipitate. The wax is filtered by vacuum and washed with seven parts of a solution of ISOPAR G and acetone in a 3:4 ratio of ISOPAR G to acetone. The wax cake is recovered, and the residual solvents stripped from the cake by heating. This process produces a wax cake in the amount of about 35 percent or more of the original waxy feed having less than about 0.5 percent oil content and a melting point of about 145° F. (62.78° C.).

EXAMPLE 31

In this example Exxon's 3656 Petrolatum (similar to a slack wax only the petrolatum contains a higher melt microcrystalline wax) containing approximately 7 percent oil is used in separating the high melt fraction of the wax. Ten parts of 3656 is put into solution in twenty parts of ISOPAR G with gentle heating. After everything is in solution the mixture is cooled to about room temperature. After cooling, twenty five parts of acetone is added, producing a wax precipitate. The wax is recovered by vacuum filtration and washed with twenty parts of a solution containing ISOPAR G and acetone in a 1:1 ratio. The residual solvents are recovered by heating, producing a final wax cake containing less than about 0.2 percent oil and having a melting point above 150° F. (65.56° C.).

EXAMPLE 32

The procedure is the same as in Example 30–31 except the acetone is substituted for by a solution containing 5% by weight of NaI in acetone.

EXAMPLE 33

The procedures are the same as in the selected one of Examples 16 to 27 except the water is substituted for by a brine solution containing 5% by weight NaCl in water.

From the foregoing description and explanation it will be seen that the present invention provides a very practical, efficient, and cost effective procedure for separating high melting point waxy constituents of a hydrocarbon mixture to produce useful and valuable products such as commercial grade waxes with low oil content, and lubricating oils with low pour points. The nature of the processes can be tailored to fit a wide variety of feed stock materials and/or a variety of desired end product characteristics. In addition to the variations and modifications of the invention presented above, it will be apparent to those skilled in the art that other variations and modifications may be made within the scope of the invention, and accordingly the scope of the invention is not to be considered limited to the particular embodiments and examples described or suggested but is rather to be determined by reference to the appended claims.

What is claimed is:

1. A process for separating wax from a quantity of hydrocarbon containing wax in solution therein comprising the steps of:

(a) maintaining said quantity of hydrocarbon at a temperature sufficient for fluidity;

(b) adding a light-to-intermediate hydrocarbon solvent which is essentially free of acetone, methanol, ethanol, isopropanol or propanol the ratio by weight of said solvent to said quantity of hydrocarbon being at least about 1:4;

(c) producing a homogeneous solution of said solvent and said quantity;

(d) thereafter admixing a co-solvent with said homogeneous solution to cause a wax precipitate to form therein wherein said co-solvent is a chemical selected from the group consisting of water and hydrocarbon miscible ketones, alcohols, aldehydes, or acids each represented by the formula $C_aH_bO_c$ where a, b, and c are integers and a is less than 5, b is divisible by 2, and c is less than 3, the ratio by weight of said co-solvent to said solvent being at least about 1:10; and (e) separating said wax precipitate from said solution.

2. The process as recited in claim 1 further comprising the step of adding water to said solution and allowing further precipitation of crystallized wax.

3. The process as recited in claim 1 wherein said co-solvent is added to said homogeneous solution in a ratio by weight of said co-solvent to said quantity of hydrocarbon of at least 1:1.

4. The process recited in claim 1 wherein said co-solvent and said solvent are each separately recovered from the process for reuse.

5. The process as recited in claim 1 wherein the ratio by weight of said solvent to said quantity of hydrocarbon is at least 5:1.

6. The process as recited in claim 1 further comprising the step of heating said quantity of hydrocarbon to at least 75° F.

7. The process as recited in claim 1 wherein said wax precipitate is washed with said co-solvent to remove amorphous hydrocarbon residue.

8. A process for separating waxes from a liquid hydrocarbon mixture containing such waxes in solution comprising the steps of:

(a) maintaining said liquid hydrocarbon mixture at a temperature sufficient for fluidity;

(b) adding a solvent to said liquid hydrocarbon mixture selected from the group consisting of formaldehyde, formic acid, methanol, ketene, acetaldehyde, acetic acid, ethanol, acetone, propionaldehyde, propionic acid, propanol, and isopropanol in a ratio between 0.1:1 and 20:1 by weight to the heavy hydrocarbon content of said liquid hydrocarbon mixture, (c) adding water to said liquid hydrocarbon mixture, (d) allowing wax components of said liquid hydrocarbon mixture to crystallize to solid form (e) physically separating the solid crystallized wax from said liquid hydrocarbon mixture.

9. The process as recited in claim 8 wherein said solvent is added to said hydrocarbon mixture in a ratio weight of at least 0.5:1.

10. The process as recited in claim 8 further comprising the step of heating said hydrocarbon mixture to at least 75° F.

11. A process for separately and sequentially separating waxes of different melting points from a liquid hydrocarbon mixture of light-to-intermediate hydrocarbons and heavy hydrocarbons containing such waxes in solution comprising the steps of:

(a) maintaining said liquid hydrocarbon mixture at a temperature sufficient for fluidity;

(b) adding a co-solvent to said mixture selected from the group consisting of formaldehyde, acetone, ketene, acetaldehyde, methanol, ethanol, propionaldehyde, isopropanol, propanol, acetic acid, formic acid, and propionic acid, the ratio by weight of said co-solvent to the heavy hydrocarbon content of said mixture being between 0.1:1 and 20:1;

(c) adding said co-solvent to said liquid hydrocarbon mixture to cause wax components of said liquid hydrocarbon mixture to crystallize to solid form;

(d) physically separating the solid crystallized wax components from said liquid hydrocarbon mixture;

(e) adding water to said liquid hydrocarbon mixture;

(f) mixing said water and said liquid hydrocarbon mixture and allowing further wax components of said liquid hydrocarbon mixture to crystallize; and (g) physically separating crystallized wax components from said liquid hydrocarbon mixture.

12. The process as recited in claim 11 wherein said co-solvent is added to said volume of hydrocarbon in a ratio by weight of at least 0.5:1.

13. The process as recited in claim 11 further comprising the step of heating said volume of hydrocarbon to at least 75° F.

14. The process as recited in claim 11 wherein said wax precipitate is washed with said co-solvent to remove amorphous hydrocarbon residue.

15. A process for removing wax from a quantity of hydrocarbon containing wax in solution therein comprising:

(a) forming a solution of said quantity with a solvent essentially free of formaldehyde, formic acid, methanol, ketene, acetaldehyde, acetic acid, ethanol, acetone, propionaldehyde, propionic acid, propanol, and isopropanol;

(b) thereafter forming a mixture of a co-solvent and said solution at a temperature sufficiently high to maintain fluidity to cause wax precipitate to form therein wherein said co-solvent comprises a chemical having an empirical formula of $C_aH_bO_c$ where a is 1, 2, or 3, b is an even number less than 13, and c is 1 or 2;

(c) while not allowing said mixture to contact a surface with a temperature which would cause a significant reduction in the temperature of said mixture, separating wax precipitate from said mixture.

16. The process as recited in claim 15 wherein said co-solvent is acetone.

17. The process as recited in claim 15 wherein said co-solvent is an organic acid chosen from the group consisting of formic acid, acetic acid and propionic acid.

18. The process as recited in claim 15 wherein said co-solvent is substantially totally miscible with water, substantially totally miscible with said solvent and substantially immiscible with waxes.

19. The process as recited in claim 15 further including the step of adding a further quantity of said co-solvent to induce additional wax precipitation.

20. The process as recited in claim 15 wherein said co-solvent is an alcohol chosen from the group consisting of methanol, ethanol, propanol, and isopropanol.

21. The process as recited in claim 15 wherein said co-solvent is chosen from the group consisting of formaldehyde, acetaldehyde, acetone, ketene, and propionaldehyde.

22. The process as recited in claim 15 wherein said co-solvent is more volatile than said solvent.

23. The process as recited in claim 15 wherein b is less than 2a+2.

24. The process as recited in claim 15 wherein a is 1 or 2.

25. A process for removing wax from a quantity of hydrocarbon containing wax in solution therein comprising:

(a) forming a solution of said quantity with a solvent consisting essentially of one or more light-to-intermediate hydrocarbons;

(b) thereafter forming a mixture of a co-solvent and said solution at a temperature sufficiently high to maintain fluidity to cause a wax precipitate to form therein wherein said co-solvent comprises a chemical which is in a liquid state at room temperature and 10 atm pressure but more volatile than said solvent, and having an empirical formula of $C_aH$-

$_bO_c$ where a is 1, 2, or 3, b is an even number less than 13, and c is 1 or 2; and (c) while not allowing said mixture to contact a surface with a temperature which would cause a significant reduction in the temperature of said mixture, separating wax precipitate from said mixture.

26. The process as recited in claim 25 further including the step of adding a further quantity of said co-solvent to induce additional wax precipitation.

27. The process as recited in claim 25 wherein said co-solvent is chosen from the group consisting of formaldehyde, acetaldehyde, acetone, ketene, and propionaldehyde.

28. The process as recited in claim 25 wherein said co-solvent is substantially totally miscible with water, substantially totally miscible with said solvent and substantially immiscible with waxes.

29. The process as recited in claim 25 wherein said solvent is essentially free of formaldehyde, formic acid, methanol, ketene, acetaldehyde, acetic acid, ethanol, acetone, propionaldehyde, propionic acid, propanol, and isopropanol.

30. The process as recited in claim 25 wherein said co-solvent is acetone.

31. The process as recited in claim 25 wherein said co-solvent is an organic acid chosen from the group consisting of formic acid, acetic acid and propionic acid.

32. The process as recited in claim 25 wherein said co-solvent is an alcohol chosen from the group consisting of methanol, ethanol, propanol, and isopropanol.

33. The process as recited in claim 25 wherein b is less than $2a+2$.

34. The process as recited in claim 25 wherein a is 1 or 2.

35. A process for removing wax from a quantity of hydrocarbon containing wax in solution therein, comprising:

(a) forming a solution of said quantity with a solvent essentially free of formaldehyde, formic acid, methanol, ketene, acetaldehyde, acetic acid, ethanol, acetone, propionaldehyde, propionic acid, propanol, and isopropanol;

(b) thereafter forming a mixture of a co-solvent and said solution at a temperature sufficiently high to maintain fluidity to cause a wax precipitate to form therein wherein said co-solvent comprises a chemical selected from the group comprising formaldehyde, formic acid, methanol, ketene, acetaldehyde, acetic acid, ethanol, acetone, propionaldehyde, propionic acid, propanol, and isopropanol; and (c) separating wax precipitate from said mixture.

36. The process as recited in claim 35 wherein said co-solvent is substantially totally miscible with water, substantially totally miscible with said solvent and substantially immiscible with waxes.

37. The process as recited in claim 35 wherein said mixture is not allowed to contact a surface which would cause a significant reduction in the temperature of said mixture.

38. The process as recited in claim 35 further including the step of adding a further quantity of said co-solvent to induce additional wax precipitation.

39. The process as recited in claim 35 wherein said co-solvent is more volatile than said solvent.

40. A process for removing wax from a quantity of hydrocarbon containing wax in solution therein comprising:

(a) forming a solution of said quantity with a solvent essentially free of alcohols having a carbon number less than four;

(b) thereafter forming a mixture of a co-solvent and said solution at a temperature sufficiently high to maintain fluidity to cause a wax precipitate to form therein wherein said co-solvent comprises an alcohol having a carbon number less than four and which is more volatile than said solvent; and (c) separating wax precipitate from said mixture.

41. The process as recited in claim 40 wherein said solvent is essentially free of formaldehyde, formic acid, methanol, ketene, acetaldehyde, acetic acid, ethanol, acetone, propionaldehyde, propionic acid, propanol, and isopropanol.

42. The process as recited in claim 40 further including the step of adding a further quantity of said co-solvent to induce additional wax precipitation.

43. The process as recited in claim 40 wherein said co-solvent is substantially totally miscible with water, substantially totally miscible with said solvent and substantially immiscible with waxes.

44. The process as recited in claim 40 wherein said mixture is not allowed to contact a surface which would cause a significant reduction in the temperature of said mixture.

45. A process for removing wax from a quantity of hydrocarbon containing wax in solution therein comprising:

(a) forming a solution of said quantity with a solvent essentially free of formaldehyde, formic acid, methanol, ketene, acetaldehyde, acetic acid, ethanol, acetone, propionaldehyde, propionic acid, propanol, and isopropanol;

(b) thereafter forming a mixture of a co-solvent and said solution at a temperature sufficiently high to maintain fluidity to cause a wax precipitate to form therein wherein said co-solvent comprises an organic acid having a carbon number less than four and which is more volatile than said solvent; and (c) separating wax precipitate from said mixture.

46. The process as recited in claim 45 further including the step of adding a further quantity of said co-solvent to induce additional wax precipitation.

47. The process as recited in claim 45 wherein said co-solvent is substantially totally miscible with water, substantially totally miscible with said solvent and substantially immiscible with waxes.

48. The process as recited in claim 45 wherein said mixture is not allowed to contact a surface which would cause a significant reduction in the temperature of said mixture.

* * * * *